US006994302B1

(12) United States Patent
Simmons

(10) Patent No.: US 6,994,302 B1
(45) Date of Patent: Feb. 7, 2006

(54) LAWN MAINTENANCE SYSTEM

(76) Inventor: Willie Simmons, 922 Postfoot Cir., Georgetown, SC (US) 29440

( * ) Notice: Subject to any disclaimer, the term of this patent is extended or adjusted under 35 U.S.C. 154(b) by 0 days.

(21) Appl. No.: 10/704,953

(22) Filed: Nov. 10, 2003

(51) Int. Cl.
*A63B 55/08* (2006.01)

(52) U.S. Cl. ..... 248/98; 248/97; 141/390; 141/391

(58) Field of Classification Search ..... 248/98, 248/97, 99, 101; 280/47.19, 654, 655; 141/390, 141/391
See application file for complete search history.

(56) References Cited

U.S. PATENT DOCUMENTS 524,041 A * 8/1894 Kelouge ..... 248/101
2,455,729 A * 12/1948 Byers ..... 248/98
3,893,699 A * 7/1975 Morris ..... 280/659
4,749,158 A * 6/1988 Buckley ..... 248/98
5,048,778 A * 9/1991 Wright ..... 248/98
5,456,431 A * 10/1995 Ilnisky ..... 248/98
5,947,492 A * 9/1999 Hallberg, Jr. ..... 280/47.24
6,092,767 A * 7/2000 Schrager ..... 248/98
6,352,225 B1 * 3/2002 Dooley et al. ..... 248/98
6,666,465 B2 * 12/2003 Chan ..... 280/47.26

* cited by examiner

*Primary Examiner*—Kimberly Wood
*Assistant Examiner*—Amy J. Sterling
(74) *Attorney, Agent, or Firm*—Edward P. Dutkiewicz

(57) ABSTRACT

A frame has a small horizontal section and a large vertical section and a juncture there between. A pair of axially spaced wheels is provided at the juncture. A hollow tube extends upwardly from adjacent the horizontal section to a location above the vertical section. A funnel with a back face and a front face is provided. The funnel also has an open upper end and an open lower end. The back face is formed with a ledge. A rod extends downwardly from the ledge. The rod is selectively positioned between an operative position and an inoperative position. In the operative position the rod is within the hollow tube. In the inoperative position the rod is separated from the hollow tube for storage purposes.

1 Claim, 3 Drawing Sheets

FIG 5
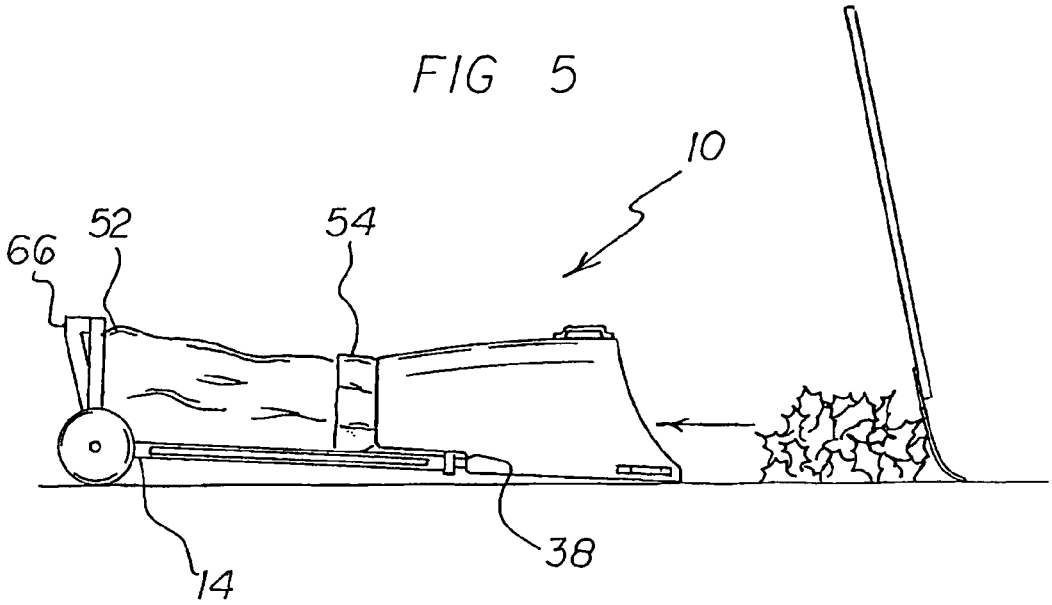
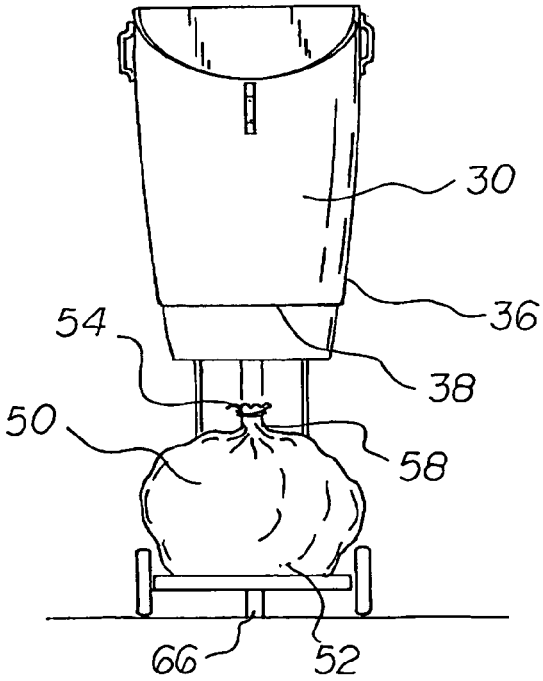
FIG 6

LAWN MAINTENANCE SYSTEM

BACKGROUND OF THE INVENTION

1. Field of the Invention

The present invention relates to a lawn maintenance system and more particularly pertains to raking and bagging leaves and other lawn debris and refuse in a convenient manner.

2. Description of the Prior Art

The use of containers of known designs and configurations is known in the prior art. More specifically, containers of known designs and configurations previously devised and utilized for the purpose of assisting a user in containing debris through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 754,580 issued Mar. 15, 1904 to Madden relates to a bag holder. U.S. Pat. No. 3,893,699 issued Mar. 15, 1904 to Morris relates to a refuse bag holder. U.S. Pat. No. 6,131,861 issued Oct. 17, 2000 to Fortier relates to a bag holder. Lastly, U.S. Pat. No. 6,585,304 issued Jul. 1, 2003 to Madden relates to a yard leaf caddy.

While these devices fulfill their respective, particular objectives and requirements, the aforementioned patents do not describe a lawn maintenance system that allows raking and bagging leaves and other lawn debris and refuse in a convenient manner.

In this respect, the lawn maintenance system according to the present invention substantially departs from the conventional concepts and designs of the prior art, and in doing so provides an apparatus primarily developed for the purpose of raking and bagging leaves and other lawn debris and refuse in a convenient manner.

Therefore, it can be appreciated that there exists a continuing need for a new and improved lawn maintenance system which can be used for raking and bagging leaves and other lawn debris and refuse in a convenient manner. In this regard, the present invention substantially fulfills this need.

SUMMARY OF THE INVENTION

In view of the foregoing disadvantages inherent in the known types of containers of known designs and configurations now present in the prior art, the present invention provides an improved lawn maintenance system. As such, the general purpose of the present invention, which will be described subsequently in greater detail, is to provide a new and improved lawn maintenance system and method which has all the advantages of the prior art and none of the disadvantages.

To attain this, the present invention essentially comprises a frame. The frame has a small horizontal section and a large vertical section. The horizontal and vertical sections are secured together at a juncture.

A pair of axially spaced wheels is provided. The wheels are rotatable about a horizontal axis. The axis extends through the juncture to facilitate rolling movement and tipping of the frame during operation and use.

Next provided is a hollow tube. The hollow tube extends upwardly from adjacent the horizontal section to a location above the vertical section. The tube is laterally disposed centrally with respect to the sections.

A funnel is provided. The funnel is formed of an essentially rigid material, preferably plastic or metal. The funnel has an essentially flat back face and an essentially semi-cylindrical front face. The funnel has a large open upper end and a small open lower end. Tapering side walls are provided between the upper and lower ends. The back face is formed with a horizontal ledge at an intermediate elevation. A rod extends downwardly from the ledge to a location beneath the open lower end of the funnel. The rod is selectively positioned between an operative position and an inoperative position. In the operative position, the rob is positioned within the hollow tube. In the inoperative position the rod is separated from the hollow tube for storage purposes.

Provided next is a plurality of handles. The handles include a pair of side handles. The handles also include a front handle on the funnel adjacent to the open upper end of the funnel to facilitate handling.

A flexible bag is provided. The flexible bag has a closed bottom end. The closed bottom end is positionable on the horizontal section. An open top end is provided. The open top end is positionable to receive the open bottom end of the funnel. A side edge is provided. The side edge is positionable against the vertical section. A tie is provided for securing the bag when full.

Further provided is a rubber band. The rubber band is positionable around the open top end of the bag and the open lower end of the funnel. In this manner the bag is retained in position with respect to the funnel.

Provided last is an essentially 7-shaped support. The support depends from the horizontal support midway between the wheels. The support extending downwardly to an elevation essentially equal to the elevation of the bottoms of the wheels. In this manner the system may be oriented with the horizontal support horizontal. Note FIGS. 1 and 2. The system may also be oriented with the horizontal support essentially vertical for raking leafs and lawn debris and refuse through the funnel into the bag. Note FIG. 5.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lawn maintenance system which has all of the advantages of the prior art containers of known designs and configurations and none of the disadvantages.

It is another object of the present invention to provide a new and improved lawn maintenance system which may be easily and efficiently manufactured and marketed.

It is further an object of the present invention to provide a new and improved lawn maintenance system which is of durable and reliable constructions.

An even further object of the present invention is to provide a new and improved lawn maintenance system which is susceptible of a low cost of manufacture with regard to both materials and labor, and which accordingly is then susceptible of low prices of sale to the consuming public, thereby making such lawn maintenance system economically available to the buying public.

Even still another object of the present invention is to provide a lawn maintenance system for raking and bagging leaves and other lawn debris and refuse in a convenient manner.

Lastly, it is an object of the present invention to provide a new and improved lawn maintenance system. A frame has a small horizontal section and a large vertical section and a juncture there between. A pair of axially spaced wheels is provided at the juncture. A hollow tube extends upwardly from adjacent the horizontal section to a location above the vertical section. A funnel with a back face and a front face is provided. The funnel also has an open upper end and an open lower end. The back face is formed with a ledge. A rod extends downwardly from the ledge. The rod is selectively positioned between an operative position and an inoperative position. In the operative position the rod is within the hollow tube. In the inoperative position the rod is separated from the hollow tube for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side elevational view of the lawn maintenance system shown in the prior Figures but with the system tipped 90 degrees for raking and bagging leaves and other lawn debris and refuse.

FIG. 6 is a front elevational view similar to FIG. 1 but with a bag full and tied.

INVENTOR COMMENTS

Figure 1:
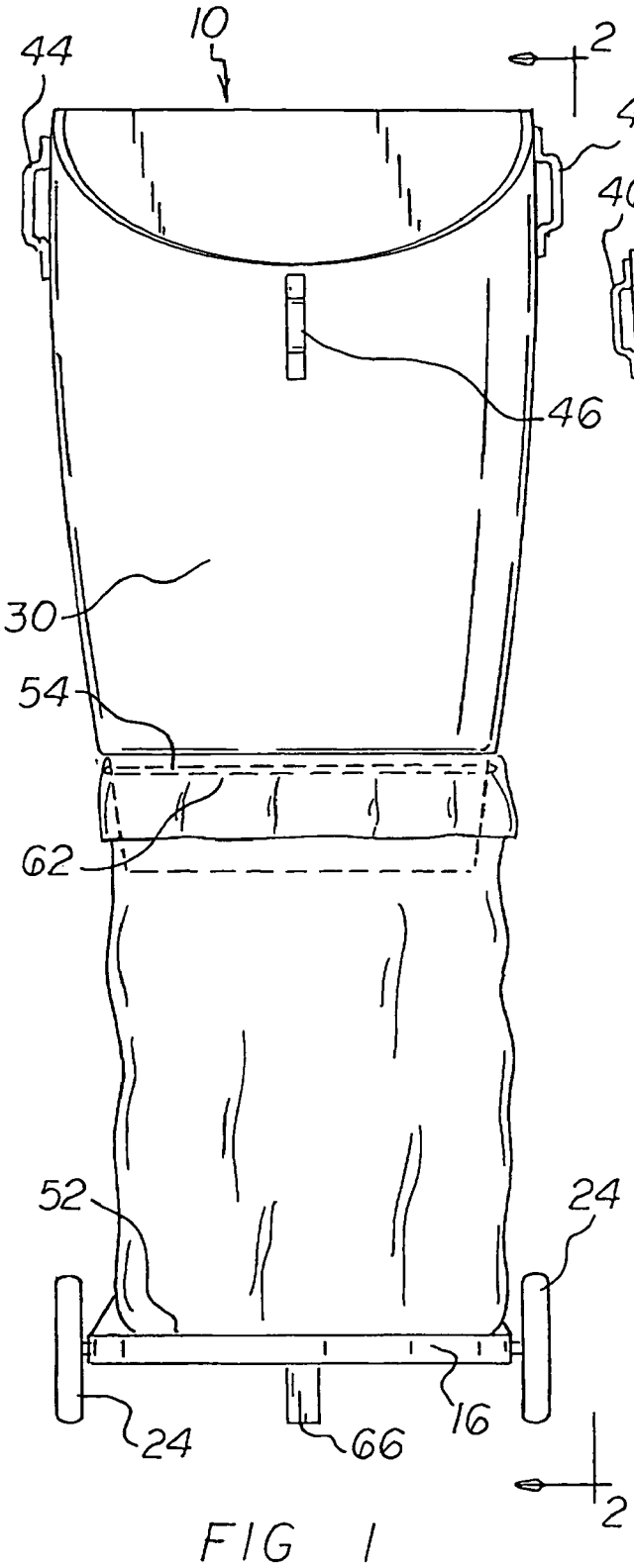
FIG. 1 is a front elevational view of a lawn maintenance system constructed in accordance with the principles of the present invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved lawn maintenance system embodying the principles and concepts of the present invention and generally designated by the reference numeral 10 will be described.

The present invention, the lawn maintenance system 10 is comprised of a plurality of components. Such components in their broadest context include a frame, a pair of axially spaced wheels, a hollow tube, and a funnel. Such components are individually configured and correlated with respect to each other so as to attain the desired objective.

First provided is a frame 14. The frame has a small horizontal section 16 and a large vertical section 18. The horizontal and vertical sections are secured together at a juncture 20.

A pair of axially spaced wheels 24 is provided. The wheels are rotatable about a horizontal axis. The axis extends through the juncture to facilitate rolling movement and tipping of the frame during operation and use.

Next provided is a hollow tube 26. The hollow tube extends upwardly from adjacent the horizontal section to a location above the vertical section. The tube is laterally disposed centrally with respect to the sections.

A funnel 30 is provided. The funnel is formed of an essentially rigid material, preferably plastic or metal. The funnel has an essentially flat back face 32 and an essentially semi-cylindrical front face 34. The funnel has a large open upper end and a small open lower end. Tapering side walls 36 are provided between the upper and lower ends. The back face is formed with a horizontal ledge 38 at an intermediate elevation. A rod 40 extends downwardly from the ledge to a location beneath the open lower end of the funnel. The rod is selectively positioned between an operative position and an inoperative position. In the operative position, the rob is positioned within the hollow tube. In the inoperative position the rod is separated from the hollow tube for storage purposes.

Provided next is a plurality of handles 44, 46. The handles include a pair of side handles 44. The handles also include a front handle 46 on the funnel adjacent to the open upper end of the funnel to facilitate handling.

A flexible bag 50 is provided. The flexible bag has a closed bottom end 52. The closed bottom end is positionable on the horizontal section. An open top end 54 is provided. The open top end is positionable to receive the open bottom end of the funnel. A side edge 56 is provided. The side edge is positionable against the vertical section. A tie is provided 58 for securing the bag when full.

Further provided is a rubber band 62. The rubber band is positionable around the open top end of the bag and the open lower end of the funnel. In this manner the bag is retained in position with respect to the funnel.

Provided last is an essentially 7-shaped support 66. The support depends from the horizontal support midway between the wheels. The support extending downwardly to an elevation essentially equal to the elevation of the bottoms of the wheels. In this manner the system may be oriented with the horizontal support horizontal. Note FIGS. 1 and 2.

The system may also be oriented with the horizontal support essentially vertical for raking leafs and lawn debris and refuse through the funnel into the bag. Note FIG. 5.

Figure 2:
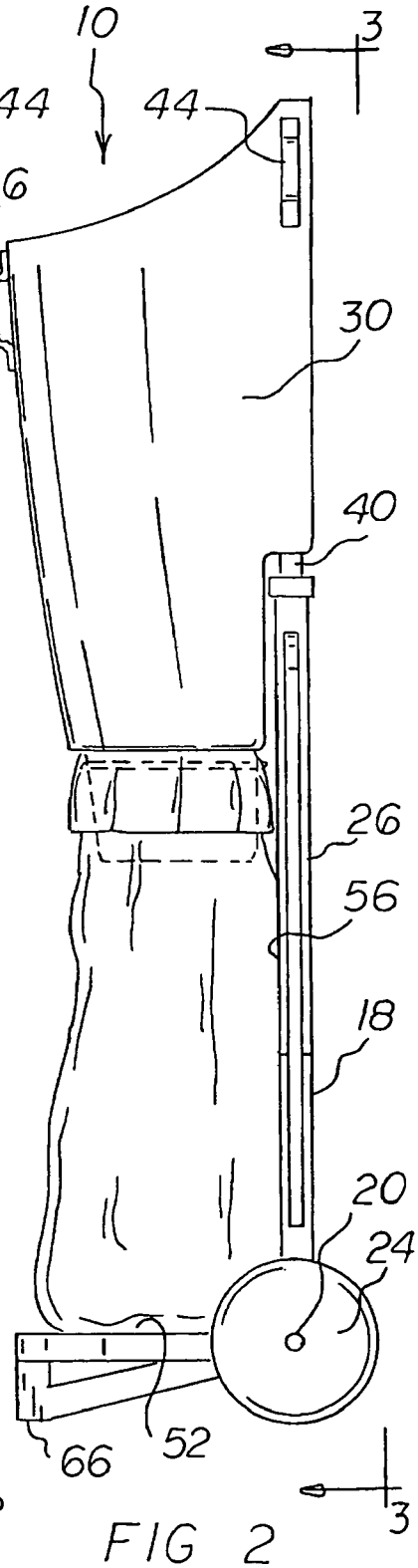
FIG. 2 is a side elevational view of the lawn maintenance system shown in FIG. 1, taken along line 2—2 of FIG. 1.
Figure 3:
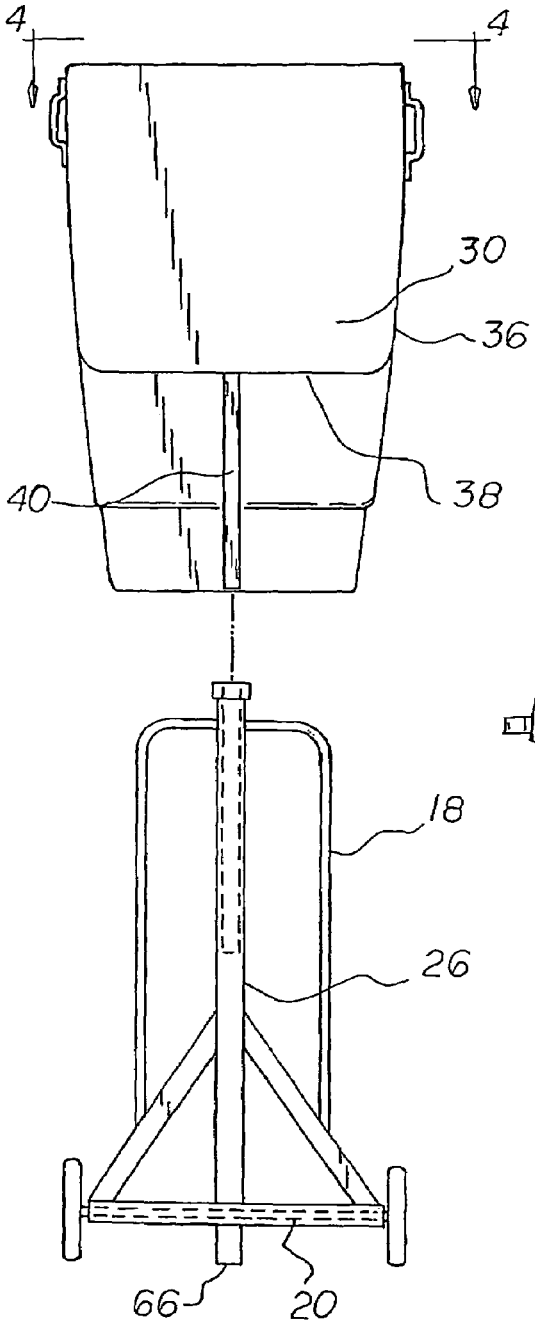
FIG. 3 is an exploded rear elevational view of the system shown in FIGS. 1 and 2.
Figure 4:
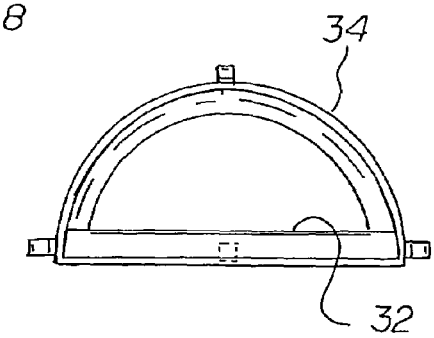
FIG. 4 is a plan view of the funnel of the system taken along line 4—4 of FIG. 3.

The steps for utilizing the present invention are very easy. First you put a bag on the horizontal section of the frame and secure its open top end with respect to the open lower end of the funnel. This is done with the frame in an original orientation as shown in FIGS. 1 and 2. Secondly you tip the frame 90 degrees until the horizontal section faces upwardly and the vertical section is close to the ground and substantially parallel there with. This is done with the frame in a secondary orientation as shown in FIG. 5. Next you get the rake. Then rake and bag leaves and other lawn debris and refuse by raking through the funnel into the bag. Note the rake and leaves and arrow of FIG. 5. Lastly, you tip the system back to its original orientation shown in FIGS. 1 and 2. The leaves and other lawn debris and refuse will fall by gravity into the bag. Now all that is needed is to tie the bag. Note FIG. 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lawn maintenance system for raking and bagging leaves and other lawn debris and refuse in a convenient manner, comprising, in combination:

a frame having a small horizontal section and a large vertical section, the horizontal and vertical sections being secured together at a juncture;

a pair of axially spaced wheels rotatable about a horizontal axis extending through the juncture to facilitate rolling movement and tipping of the frame during operation and use;

a hollow tube extending upwardly from adjacent the horizontal section to a location above the vertical section, the tube being laterally disposed centrally with respect to the sections;

a funnel formed of an essentially rigid material with an essentially flat back face and an essentially semi-cylindrical front face and a large open upper end and a small open lower end with tapering side walls there between, the back face being formed with a horizontal ledge at an intermediate elevation with a rod extending downwardly from the ledge to a location beneath the open lower end of the funnel, the rod being selectively positioned between an operative position within the hollow tube for operation and use and an inoperative position separated from the hollow tube as for storage purposes;

a plurality of handles including a pair of side handles and a front handle on the funnel adjacent to the open upper end of the funnel to facilitate handling;

a flexible bag having a closed bottom end positionable on the horizontal section and an open top end positionable to receive the open bottom end of the funnel and a side edge positionable against the vertical section and a tie for securing the bag when full;

a rubber band positionable around the open top end of the bag and the open lower end of the funnel to retain the bag in position with respect to the funnel; and an essentially 7-shaped support depending from the horizontal support midway between the wheels and extending downwardly to an elevation essentially equal to the elevation of the bottoms of the wheels whereby the system may be oriented in a first orientation with the horizontal support horizontal and with the wheels and rod and ledge and handles in essentially vertical alignment and whereby the system may be oriented in a second orientation with the horizontal support essentially vertical and with the wheels and rod and ledge and handles in essentially horizontal alignment with the upper end of the back face of the funnel in contact with ground for raking leafs and lawn debris and refuse through the funnel into the bag.

* * * * *